US010018206B2

(12) United States Patent
Moll et al.

(10) Patent No.: US 10,018,206 B2
(45) Date of Patent: Jul. 10, 2018

(54) IMPELLER HAVING BALANCE COMPENSATION

(71) Applicant: EBM-PAPST MULFINGEN GMBH & CO. KG, Mulfingen (DE)

(72) Inventors: Jürgen Moll, Ilshofen (DE); Christian Hammel, Pfedelbach-Oberohrn (DE)

(73) Assignee: EBM-PAPST MULFINGEN GMBH & CO. KG (DE)

( * ) Notice: Subject to any disclaimer, the term of this patent is extended or adjusted under 35 U.S.C. 154(b) by 535 days.

(21) Appl. No.: 14/428,595

(22) PCT Filed: Jul. 24, 2013

(86) PCT No.: PCT/EP2013/065627
§ 371 (c)(1),
(2) Date: Mar. 16, 2015

(87) PCT Pub. No.: WO2014/044441
PCT Pub. Date: Mar. 27, 2014

(65) Prior Publication Data

US 2015/0233389 A1 Aug. 20, 2015

(30) Foreign Application Priority Data

Sep. 18, 2012 (DE) ..... 20 2012 103 554 U

(51) Int. Cl.
*F04D 29/66* (2006.01)
*F04D 19/00* (2006.01)
(Continued)

(52) U.S. Cl.
CPC ..... *F04D 29/662* (2013.01); *F04D 17/16* (2013.01); *F04D 19/002* (2013.01); *F04D 29/601* (2013.01)

(58) Field of Classification Search
CPC ..... F04D 17/16; F04D 29/662; F04D 19/062; F04D 29/601; F04D 29/281; F05D 2260/96
(Continued)

(56) References Cited

U.S. PATENT DOCUMENTS 2,221,747 A * 11/1940 Turner ..... F16F 15/324 301/5.21
3,315,750 A 4/1967 Delaney
(Continued)

FOREIGN PATENT DOCUMENTS

DE 9102865 U1 7/1992
DE 102006057087 B3 6/2008
(Continued)

OTHER PUBLICATIONS

PCT/EP2013/065627 International Search Report and Written Opinion, completed May 19, 2014.

*Primary Examiner* — Jason Shanske
*Assistant Examiner* — Jesse Prager
(74) *Attorney, Agent, or Firm* — Tarolli, Sundheim, Covell & Tummino LLP

(57) ABSTRACT

The invention relates to an impeller (1) for a fan, in particular an axial or radial fan having a hub (2) for connecting the impeller (1) to a drive motor and having fan blades (6) which are arranged circumferentially around the hub (2) and having pockets (9) in the hub region, having balance weights (15) which can be fastened therein, aligned in the axial direction. The balance weights (15) are made of U-shaped, bent weight clips made of spring-elastic material, having at least two opposite clip legs extending parallel to each other which are connected to each other via a bend section, and comprise a clamping gap between the clip legs. One of the clip legs extends within the pockets (9) and the other clip leg extends outside of the pockets (9), such that
(Continued)

Figure 1:
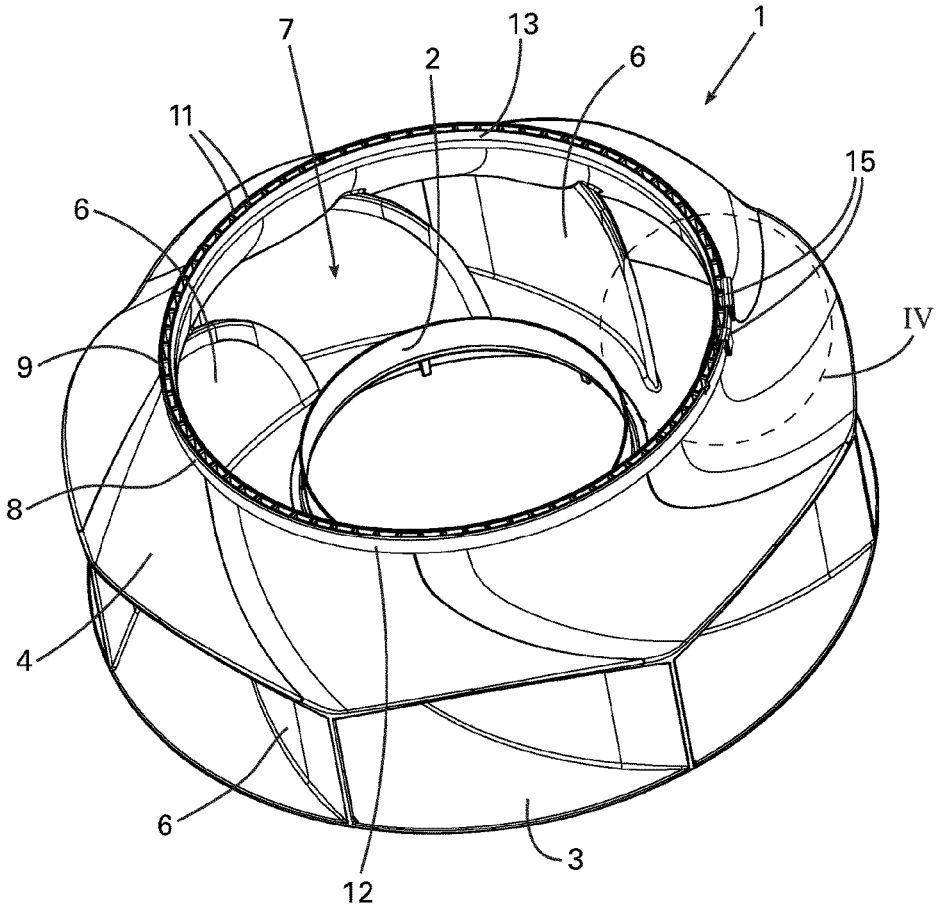

there is a clamping seat on a pocket wall (12) extending in the clamping gap.

12 Claims, 7 Drawing Sheets

(51) Int. Cl.
*F04D 17/16* (2006.01)
*F04D 29/60* (2006.01)

(58) Field of Classification Search
USPC ..... 416/144
See application file for complete search history.

(56) References Cited

U.S. PATENT DOCUMENTS

| | | | | | |
|---|---|---|---|---|---|
| 5,591,008 | A * | 1/1997 | Wrobel | ..... | F04D 29/281 416/144 |
| 2008/0075596 | A1 | 3/2008 | Kitamura | | |
| 2011/0223007 | A1* | 9/2011 | Hammel | ..... | F04D 29/662 415/119 |
| 2011/0236211 | A1* | 9/2011 | Schneider | ..... | F04D 29/662 416/144 |
| 2012/0121410 | A1* | 5/2012 | Liu | ..... | F04D 29/329 415/220 |

FOREIGN PATENT DOCUMENTS

| | | | | | |
|---|---|---|---|---|---|
| DE | 102010011526 | | 9/2011 | | |
| JP | 03141900 | | 3/2001 | | |
| WO | WO 02097279 | A1 * | 12/2002 | ..... | F04D 29/326 |
| WO | WO 2010025976 | A1 * | 3/2010 | ..... | F04D 29/662 |

* cited by examiner

IMPELLER HAVING BALANCE COMPENSATION

RELATED APPLICATIONS

The present invention is a U.S. National Stage under 35 USC 371 patent application, claiming priority to Serial No. PCT/EP2013/065627, filed on 24 Jul. 2013; which claims priority from DE 20 2012 103 554.5, filed 18 Sep. 2012, the entirety of both of which are incorporated herein by reference.

The present invention relates to an impeller for a fan, especially an axial or radial fan, having a hub to connect the impeller to a drive motor and having fan blades that are arranged around the hub along the circumference and, in the hub area, having pockets that are oriented in the axial direction and that have balancing weights that can be fastened therein.

German patent document DE 10 2006 057 087 describes a generic impeller. Here, balancing weights configured as insertable weights are pressed or inserted into the pockets. These insertable weights are hammered in or pressed in with a hammer, a manual punch or a press. For this purpose, the impeller in question has to be taken out of its installed position in a balance machine, whereby beforehand, the impeller has to be fitted with a balance marker so that the balancing weight can be installed in the precise position when the impeller is in the dismantled state.

U.S. Appln. No. 2008/0075596 A1 describes the use of U-shaped bent, resilient balancing clips as balancing weights that are slid in the radial direction onto a radially arranged ring collar on the hub of the impeller. For this purpose, in order to fasten the weight, the impeller has to be taken out of the balance machine after each measuring procedure, which is very labor-intensive and time-consuming. Moreover, this procedure does not allow balancing in different axial planes on different radii.

German patent document DE 10 2010 011 526.6 discloses the approach of fastening U-shaped bent balancing clips as balancing weights on the edges of the top or bottom disc by sliding these clips on in the radial direction. With this type of fastening technique, there is a risk that, at high rotational speeds, the balancing clips will be spun off or will move out of their position due to the resultant centrifugal forces. Moreover, at high rotational speeds and at the high flow rates resulting therefrom, undesired flow noises occur because the balancing weights are situated in the air flow. The same applies to balancing weights that are configured as balancing clips and that are fastened to the fan blades.

The present invention is based on the objective of, starting with a generic impeller, making it possible to easily install the balancing weights by hand directly in the balance machine. Here, a precisely positioned and secure fastening of the balancing weights over the entire circumference of the impeller should be possible and undesired flow noises due to the balancing weights should be avoided.

According to the invention, this is achieved in that the balancing weights are in the form of U-shaped bent balancing clips made of resilient material, each having at least two opposing clip legs that are connected to each other via an arced section and that enclose a clamping gap between the clip legs, whereby one of the clip legs runs inside the pockets while the other clip leg runs outside of the pockets, so that a clamping fit is achieved on a pocket wall that runs in the clamping gap. Thanks to the embodiment according to the invention, a precise placement of the balancing clips on the impeller is possible and the balancing clips according to the invention cannot be spun off of the fan due to the centrifugal forces. Moreover, the balancing clips do not generate any noises either since they are not arranged in the air flow of the fan. The embodiment according to the invention permits a very easy placement by hand, and the balancing clips also hold very securely in the appertaining balance pockets. No tools such as, for example, manual punches, hammers or presses, are necessary for the placement of the balancing clips according to the invention. Moreover, the placement of the balancing clips in the balance pockets can be carried out in the installed position in the balance machine. This saves time when the fan is being loaded into or unloaded from the balance machine, and moreover, so-called tandem balance machines can be used. Furthermore, so-called double-sensor techniques for locating the unbalance on the fan, which make use of indexing aids, can be employed. Moreover, it is no longer necessary to provide balance markers on the fan in order to achieve a precisely positioned balancing.

Figure 2:
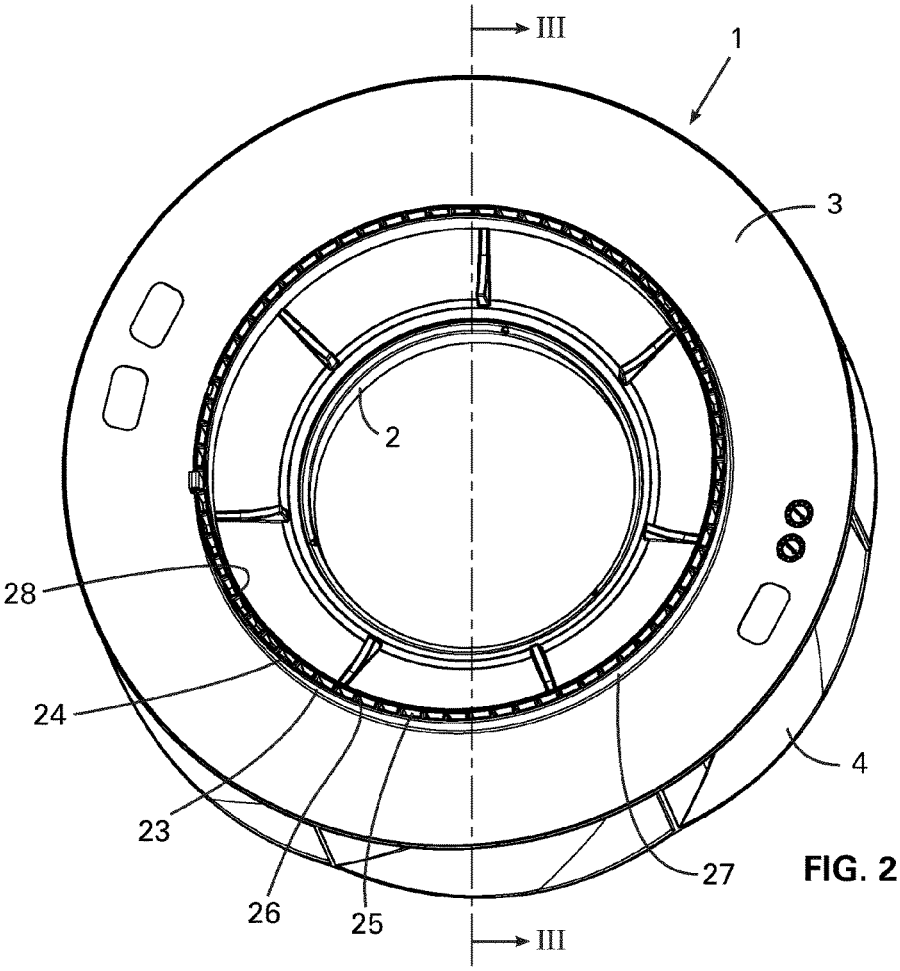
Figure 3:
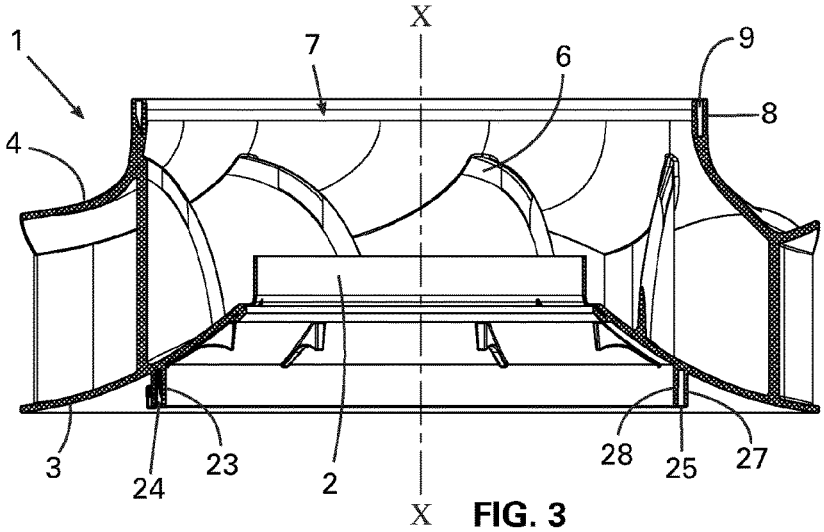
Figure 4:
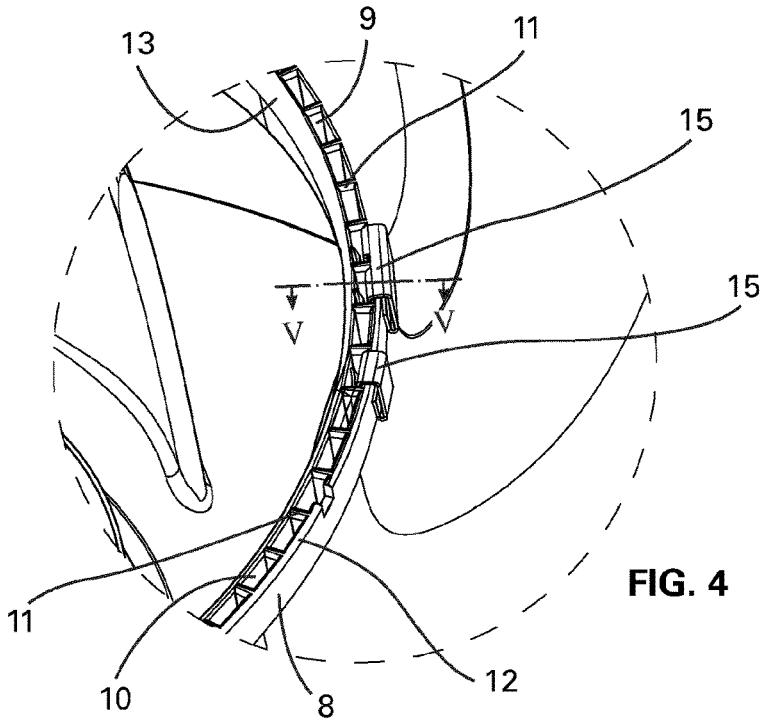
Figure 5:
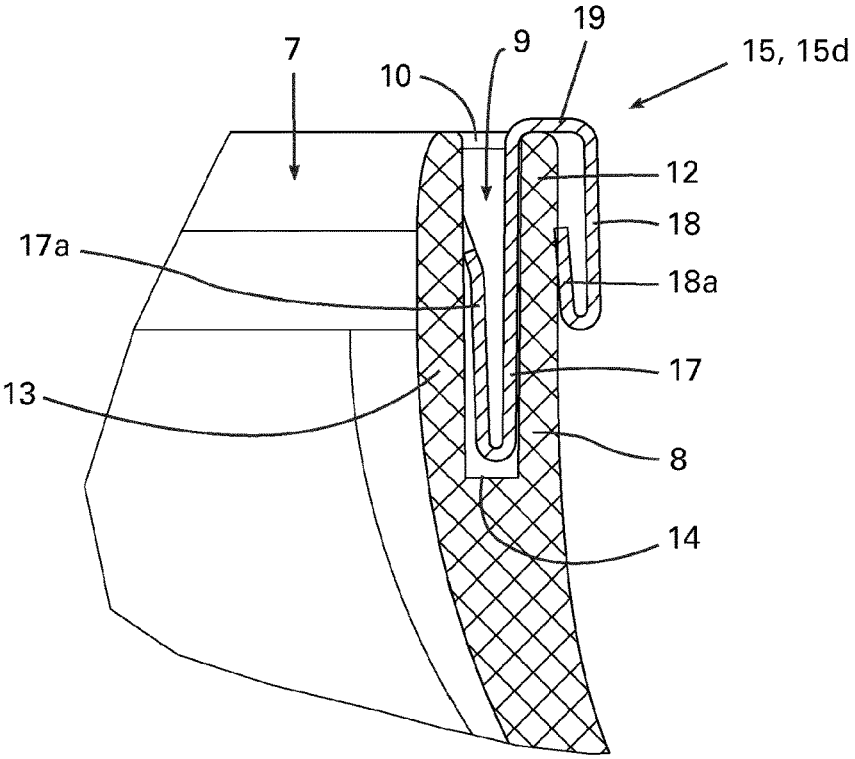
Figure 6:
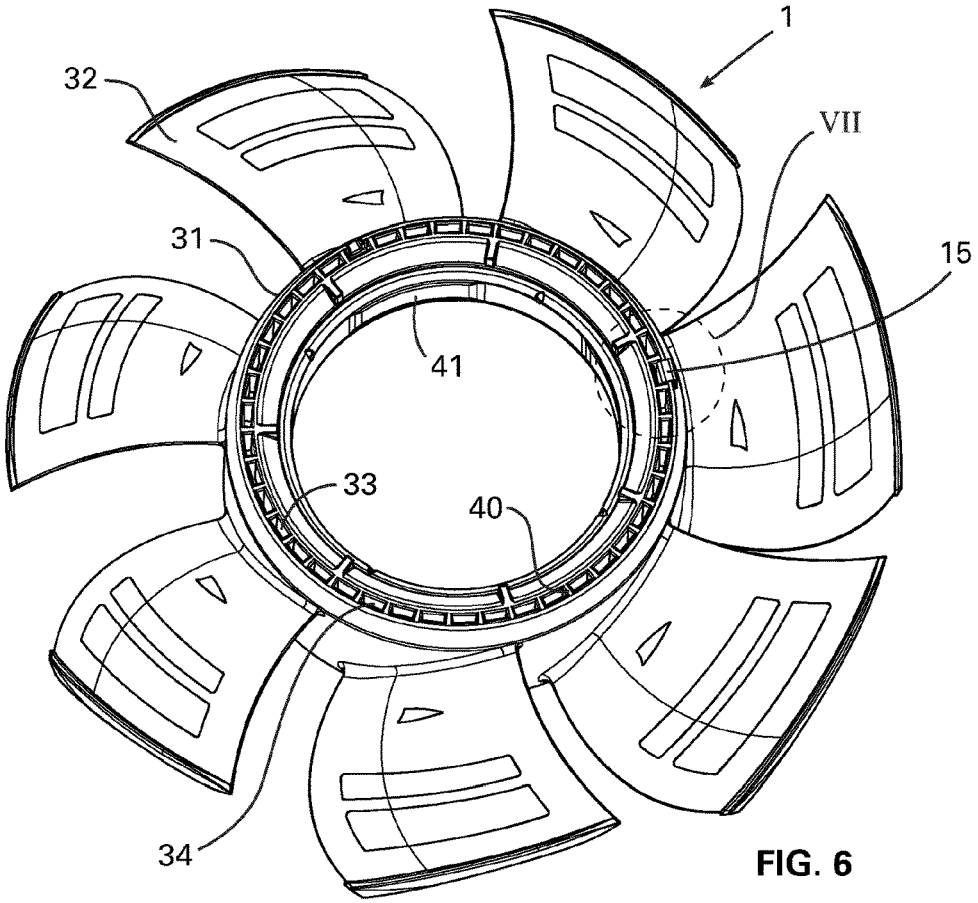
Figure 7:
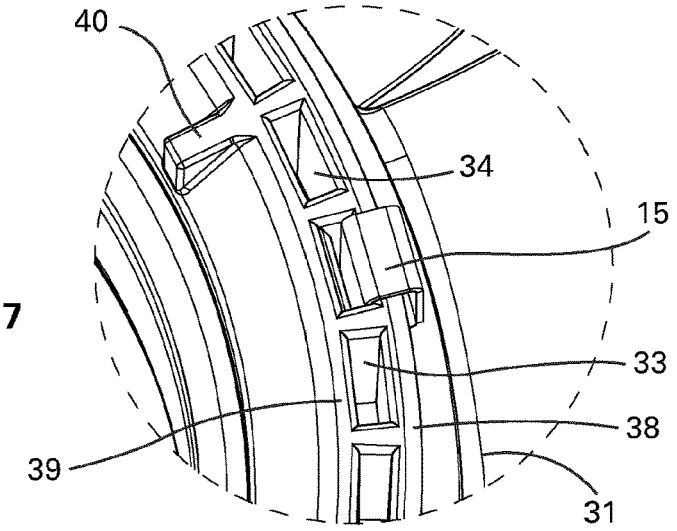
Figure 8:
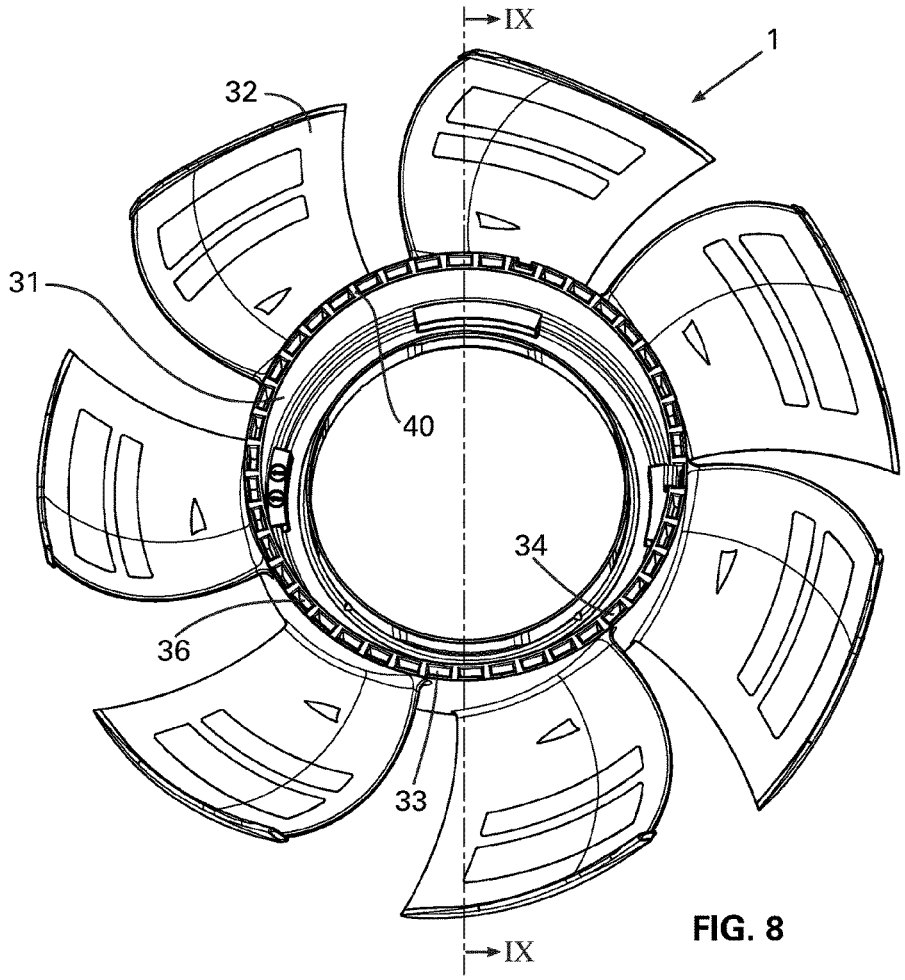
Figure 9:
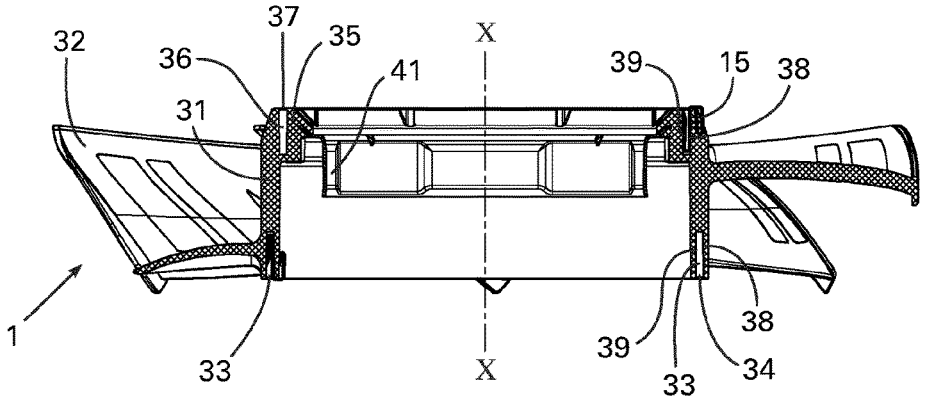
Figure 10:
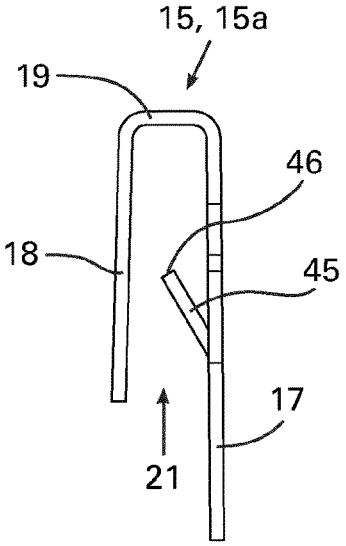
Figure 11:
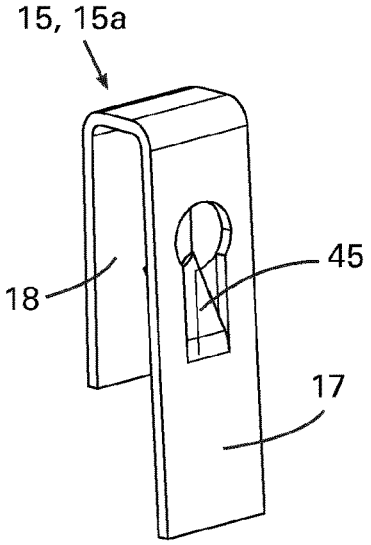
Figure 12:
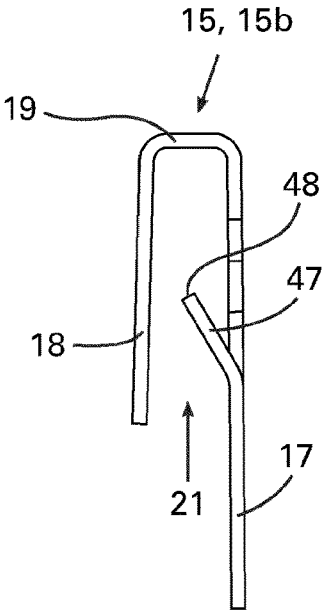
Figure 13:
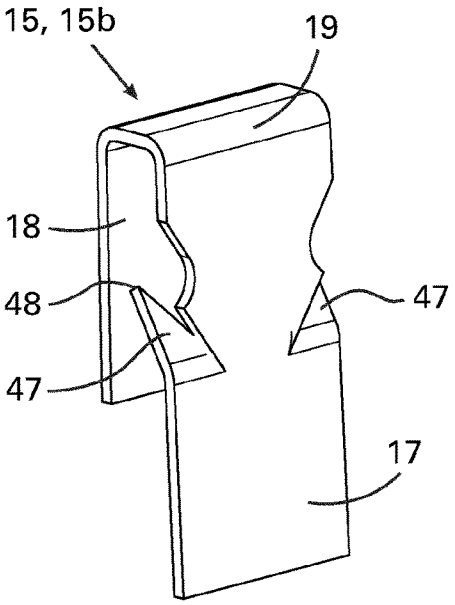
Figure 14:
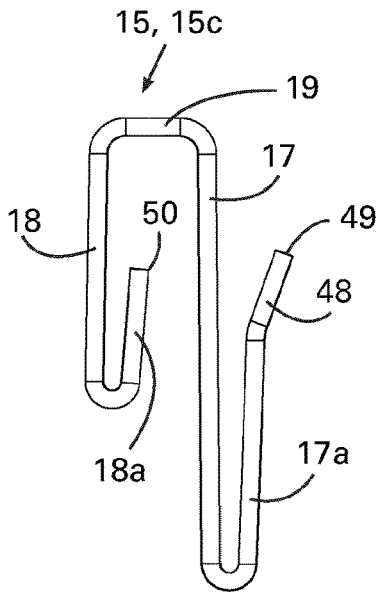
Figure 15:
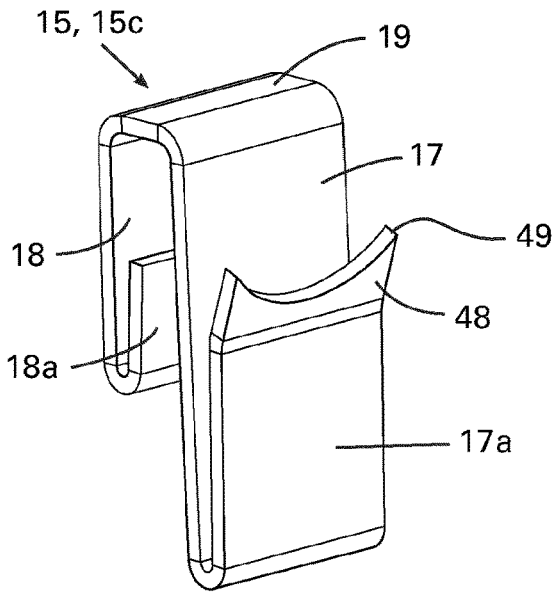
Figure 16:
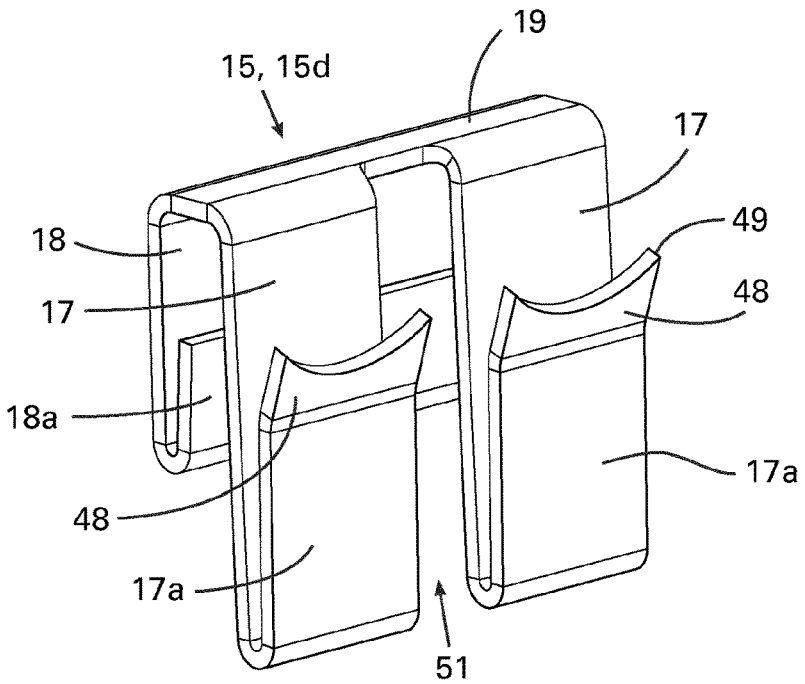

Advantageous embodiments of the invention are contained in the subordinate claims and are explained in greater detail with reference to the embodiments shown in the accompanying drawings. The following is shown:

FIG. 1 a perspective front view of an impeller according to the invention configured as a radial fan wheel, FIG. 2 a perspective rear view of the impeller according to FIG. 1, FIG. 3 a section along the sectional line III-III in FIG. 2, FIG. 4 a view according to detail according to IV shown in FIG. 1, FIG. 5 a section along the sectional line V-V in FIG. 4, FIG. 6 a perspective front view of an impeller according to the invention configured as an axial fan wheel, FIG. 7 the detail according to VII in FIG. 6, FIG. 8 a rear view of the impeller according to FIG. 6, FIG. 9 a section along the sectional line IX-IX in FIG. 8, FIG. 10 a side view of a first embodiment of a balancing clip according to the invention, FIG. 11 a perspective view of the balancing clip according to FIG. 10, FIG. 12 a side view of another embodiment of a balancing clip according to the invention, FIG. 13 a perspective view of the balancing clip according to FIG. 12, FIG. 14 another embodiment in a side view of a balancing clip according to the invention, FIG. 15 a perspective view of the balancing clip according to FIG. 14, and FIG. 16 another embodiment of a balancing clip according to the invention in a perspective view.

In FIGS. 1 to 16, the same parts or functionally equivalent parts are designated by the same reference numerals. If certain features of the impeller according to the invention or of its components are only described in conjunction with an embodiment and/or can be derived from the drawings, then these features are also essential according to the invention, independently of this embodiment as an individual feature or else in combination with other features of the embodiment, and are to be considered as belonging to the invention.

In the present application, when mention is made of an axial direction, this refers to a direction parallel to the axis of rotation, whereas when mention is made of a radial direction, this refers to a direction perpendicular to the axis of rotation.

FIG. 1 shows a perspective front view of an impeller 1 according to the invention that is configured as a radial fan wheel. This impeller 1 has a hub 2 with which the impeller 1 is connected to a rotor of an electric drive motor, especially an external-rotor motor. For this purpose, the hub 2 has a circular cylindrical hub wall. Moreover, the impeller 1 consists of a circular bottom disc 3 and of a circular top disc 4 arranged axially opposite from it. Between these two discs 3, 4, there are wheel blades 6 that, due to their design and arrangement, generate an air flow through the impeller 1 when the impeller 1 is turning.

The top disc 4 has a circular inflow opening 7 into which the incoming medium flows in in the axial direction when the impeller 1 is turning. As can be seen in FIG. 1, the top disc wall has a concave curved shape and, at the ends, it has a circular cylindrical rim 8 that surrounds the inflow opening 7. In its wall, the rim 8 has axially arranged pockets 9 which are in the form of a cavity open on one side and which are configured around the entire circumference of the rim 8. The pockets 9 have pocket openings 10 facing away from the bottom disc 3 and they are separated from each other by separating webs 11. The pockets 9 are delimited in the radial direction towards the outside by an outer wall 12 and in the radial direction towards the inside by an inner wall 13. Moreover, the pockets 9 have an inner pocket bottom 14. These pockets 9 are advantageously arranged next to each other over the entire circumference of the rim 8 and are advantageously of the same size. These pockets 9 serve to hold balancing weights 15 that are configured as U-shaped bent balancing clips, for which purpose reference is made to FIGS. 10 to 16 described below. These balancing weights 15 configured as balancing clips have at least two opposing clip legs 17, 18 that are connected to each other via an arced section 19; see, for example, FIGS. 10 to 13. These balancing clips are made of a resilient material, especially spring steel. When the balancing clips 15 have been slid on, they are positioned in such a way that one clip leg 17 is inside a given pocket 9 whereas the other clip leg 18 runs outside of said pocket 9, thereby creating a clamped seat on the outer wall 12 that runs inside the clamping gap 21 formed by one of the two clip legs 17, 18. The balancing weights configured as balancing clips 15 can easily be slid in place axially. This can be done manually inside the balance machine with little application of force. Thanks to the pockets 9 that are present over the entire 360° circumference, very precise balancing is possible. Moreover, it is advantageous according to the invention for a ring collar 23 to be configured on the bottom disc 3 that is radially offset towards the outside relative to the hub 2 and that projects in the axial direction away from the bottom disc 3. In the wall of the ring collar 23, there are pockets 24 that are advantageously arranged next to each other over the entire 360° circumference of the ring collar 23. These pockets 24 are advantageously the same size as the pockets 9 in the rim 8. The pockets 24 extend in the axial direction and have pocket openings 25 facing away from the bottom disc 3. These pockets 24 likewise serve to hold the balancing weights 15 that are configured as balancing clips. The pockets 24 likewise have separating webs 26, an outer wall 27, and an inner wall 28. The radius of the ring collar 23 is smaller than the radius of the circular cylindrical rim 8, whereby the ring collar 23 and the rim 8 are arranged concentrically relative to each other in such a way as to result in two radially extending balance planes that are each axially at a distance from each other, thereby permitting a very precise balancing of the impeller 1 according to the invention. Depending on the slant of the bottom disc 3, the ring collar 23 can have a larger diameter than, or the same diameter as, the rim 8.

FIGS. 6 to 9 show an impeller 1 according to the invention that is configured as an axial fan wheel. It has a hub 31 that is configured as a hollow cylinder with a circular cross section. Fan blades 32 are arranged on the outer circumference of the hub 31. Depending on the desired conveying direction, this impeller 1 can be fastened to the motor in two different directions. For this purpose, a hollow cylindrical inner hub 41 is shaped onto a ring collar 35 and, by means of this inner hub 41, the impeller 1 is fastened to a rotor of an electric motor (not shown here). On both end faces of the hub 31, the wall of the hub 31 has pockets 33, 36 that run in the axial direction and are arranged next to each other over the entire circumference. These pockets 33, 36 are open on one side, whereby their openings 34, 37 each run in the axial direction. These pockets 33, 36 serve to hold balancing weights 15 configured as balancing clips that correspond to the balancing weights 15 that were described in conjunction with FIGS. 1 to 5 and they are fastened in the same manner. On the end opposite from the pockets 33, the wall area of the hub 31 has a ring collar 35. In this ring collar 35, pockets 36 that are open on one side and that are axially oriented are arranged over the entire circumference. The pockets 33, 36 are all the same size and arranged next to each other. Their openings 34, 37 face in the axial direction X-X. The pockets 33 and the pockets 36 advantageously have the same dimensions and have an outer wall 38, an inner wall 39 and are separated from each other by separating webs 40. The pockets 33 are arranged radially offset towards the outside relative to the pockets 36 so that the pockets 33 are situated on a larger radius than the pockets 36. This, in turn, results in two axially spaced balance planes whose radial sizes differ and which permit a very precise balancing of the impeller 1. However, as an alternative, it is also possible to install the pockets 33, 36 on the same radius.

Owing to the inventive layout of the pockets 9, 24, 33, 36, the balancing weights 15 can each be fastened in the pockets 9, 24, 33, 36 axially from the outside.

FIGS. 10 and 11 show a first embodiment of an inventive balancing clip 15*a* that serves as a balancing weight 15. This balancing clip 15*a* consists of two clip legs 17, 18, whereby the clip leg 17 is longer than the clip leg 18, and the two clip legs 17, 18 are connected to each other via an arced section 19. Here, it is provided according to the invention that, as shown in the preceding figure, the longer clip leg 17 runs inside the pockets 9, 24, 33, 36. The width of the two clip legs 17, 18 is smaller than, or equal to, the width of the pocket openings of the pockets formed in the impellers 1. A clamping gap 21 is formed between the clip legs 17, 18. On the longer clip leg 17, there is a tab 45 projecting from the clip leg surface in the direction of the arced section 19 and bent in the direction of the shorter clip leg 18, and this tab 45 has a cutting edge 46 at its free end. When the balancing clip 15*a* has been slid in place, this tab 45 prevents the balancing clip 15*a* from becoming detached from the pockets 9, 24, 33, 36, since, because of its pre-tensioning, the tab 45 with its cutting edge 46 presses into the material of the outer wall. The balancing clip 15*a* is a stamped, bent part.

FIGS. 12 and 13 show another embodiment of a balancing clip 15*b* according to the invention. This balancing clip 15*b*, in turn, consists of a longer clip leg 17 and a shorter clip leg 18 that are connected to each other via an arced section 19. This balancing clip 15*b* is also advantageously made as a stamped, bent part, and its clip legs 17, 18 are configured in such a way that they can easily be slid onto the impeller 1 according to the invention. In this embodiment, the lengthwise edges of the longer clip leg 17 that runs in the pockets 9, 24, 33, 36 once it has been put in place has opposing jagged projections 47 that protrude from the clip leg surface in the direction of the arced section 19 and that have a cutting edge 48 on one end face with which the balancing clips 15*b* can cut into the appertaining pocket wall when they have been put in place, as a result of which the balancing clips 15*b* are prevented from becoming detached. Here, too, a clamping gap 21 is enclosed between the two clip legs 17, 18.

FIGS. 14 and 15 show another inventive embodiment of a balancing clip 15*c* that can serve as a balancing weight. Here, too, there are two clip legs 17, 18, whereby the clip leg 17, in turn, is longer than the clip leg 18, and the two clip legs 17, 18 are connected to each other via an arced section 19. The ends of the clip legs 17, 18 each have an extended section 17*a*, 18*a* that is bent in the direction of the arced section 19, whereby the extended section 18*a* is shorter than the extended section 17*a*. The two extended sections 17*a*, 18*a* run parallel to each other, the extended section 18*a* runs between the clip leg 17 and the clip leg 18, and the extended section 17*a* runs on the side of the clip leg 17 facing away from the clip leg 18. Due to the configuration of the extended sections 17*a*, 18*a*, the weight of the balancing clips 15*c* is greater than the weight of the balancing clips 15*a*, 15*b*, so that this balancing clip 15*c* according to the invention is used whenever a larger balancing weight is necessary. FIG. 5 shows the arrangement of the balancing clip 15*c* inside a pocket. Here, it can be seen that the balancing clip 15*c* is supported with the extended section 17*a* on the inner wall 13 of the pocket 9 and with the extended section 18*a*, on the outer wall 12 of the pocket 9. The end of the extended section 17*a* that runs inside the pocket 9 is provided with a bent section 48 that faces away from the clip leg 17, whereby the end of said extended section 17*a* has an especially bent cutting edge 49 with which the extended section 17*a* cuts into the inner wall of the appertaining pocket, while by the same token, a cutting edge 50 at the end of the extended section 18*a* can cut into the outer wall of the appertaining pocket. The balancing clip 15*c* is also configured as a stamped, bent part, thereby making it very inexpensive to produce. The width of the clip legs 17, 18 as well as of the extended sections 17*a*, 18*a* is such that they fit inside the appertaining pocket with very little play.

FIG. 16 shows another embodiment according to the invention of a balancing clip 15*d* according to the invention. This embodiment of the balancing clip 15*d* differs from the embodiments described above in that there are two longer clip legs 17 that run parallel to each other. The distance between the two clip legs 17 is defined by a gap 51 that corresponds to the width of a separating web between the appertaining pockets. According to the embodiment of FIGS. 14 and 15, the clip legs 17, in turn, have an extended section 17*a* with a bent section 48. The shorter clip leg 18 that runs outside of the appertaining pocket has a width that corresponds to the width of two pockets that are next to each other, and this clip leg 18 is connected via the arced section 19 to the two clip legs 17 that run parallel to each other. Due to this embodiment, when the two clip legs 17 that run parallel to each other have been put in place, they run in two adjacent pockets and the shorter clip leg 18 rests on the outer wall of the pockets, thereby covering two adjacent pockets. This embodiment is used when particularly large balancing weights are desired and it simplifies the placement of the balancing clips 15*d* since, instead of two individual balancing clips, just one single balancing clip 15*d* can be put into place in one placement procedure. The shorter clip leg 18, in turn, has an extended section 18*a* as is described with reference to FIGS. 14 and 15.

As already explained, the balancing clips 15*a*, 15*b*, 15*c*, 15*d* shown in FIGS. 10 to 16 are configured as stamped, bent parts; in particular, they are made of a resilient material such as spring steel or the like. This makes them very inexpensive to produce. Moreover, according to the invention, an opening to dissipate moisture can be made in the bottom 14 of the pockets 9, 24, 33, 36.

The invention is not limited to the embodiments shown and described, but rather, it encompasses all embodiments that have the same effect as set forth in the invention. Moreover, the invention is not yet limited to the feature combinations defined in the claims, but rather, it can also be defined by any other desired combination of certain features among all of the individual features disclosed in their entirety. This means that fundamentally, practically each individual feature of the independent claims can be left out or at least replaced by an individual feature disclosed in another place in the application. Consequently, the claims are only to be understood as an initial attempt at formulating an invention.

LIST OF REFERENCE NUMERALS

1 impeller
2 hub
3 bottom disc
4 top disc
6 fan blades
7 inflow opening
8 rim
9 pockets
10 pocket openings
11 separating wall
12 pocket wall
13 inner wall
14 pocket bottom
15 balancing weights
15*a* balancing clip
15*b* balancing clip
15*c* balancing clip
15*d* balancing clip
17 clip leg
17*a* extended section
18 clip leg
18*a* extended section
19 arced section
21 clamping gap
23 ring collar
24 pockets
25 pocket opening
26 separating wall
27 pocket wall
28 inner wall
31 hub
32 fan blades
33 pockets
34 pocket opening
35 ring collar
36 pockets
37 pocket opening
38 pocket wall
39 inner wall
40 separating wall
41 hub
45 tab
46 cutting edge
47 projections
48 cutting edge
49 cutting edge
50 cutting edge

51 gap

The invention claimed is:

1. An impeller for a fan having a hub to connect the impeller to a drive motor and having fan blades that are arranged around the hub along the circumference and, in the hub area, having pockets that are oriented in the axial direction, that are open on one side in the axial direction, and that have balancing weights fastened therein, wherein the balancing weights are in the form of U-shaped bent balancing clips made of resilient material, each having at least two opposing parallel clip legs that are connected to each other via an arced section and that enclose a clamping gap between the at least two clip legs, whereby at least one of the clip legs runs inside the pockets while another of the at least two clip legs runs outside of the pockets, so that a clamping fit is achieved on a pocket wall that runs in the clamping gap, whereby the blades run between a top disc and a bottom disc and the hub is configured on the bottom disc, whereby on the one hand, the pockets are configured in a rim that surrounds an inflow opening of the top disc and, on the other hand, said pockets are configured in a ring collar that faces away axially from the top disc and that is shaped onto the bottom disc, whereby the rim and the ring collar have a circular cross section, and the diameter of the ring collar is especially larger than, or the same as, the diameter of the rim whereby the free ends of the at least two clip legs each have an extended section that is bent in the direction of the arced section, said extended section being shorter than the associated clip leg, and the at least two extended sections run parallel to each other.

2. An impeller for a fan having a hub to connect the impeller to a drive motor and having fan blades that are arranged around the hub along the circumference and, in the hub area, having pockets that are oriented in the axial direction, that are open on one side in the axial direction, and that have balancing weights fastened therein, whereby the balancing weights are in the form of U-shaped bent balancing clips made of resilient material, each having at least two opposing parallel clip legs that are connected to each other via an arced section and that enclose a clamping gap between the at least two clip legs whereby at least one of the clip legs runs inside the pockets while another of the at least two clip legs runs outside of the pockets so that a clamping fit is achieved on a pocket wall that runs in the clamping gap, whereby said fan blades are radially protruding and are formed on a hollow cylindrical portion of the hub and, on the one hand, the pockets run in an end wall formed at the front end of the hub and, on the other hand, said pockets run in a ring collar formed on the opposite end of the hub, and whereby the diameter in the area of the end wall is greater than, or equal to, the diameter in the area of the pockets of the ring collar whereby the free ends of the at least two clip legs each have an extended section that is bent in the direction of the arced section, said extended section being shorter than the associated clip leg, and the at least two extended sections run parallel to each other.

3. The impeller according to claim 1, wherein the pockets have insertion openings that are oriented in such a way that the balancing weights can each be inserted in the axial direction from the outside of the impeller.

4. The impeller according to claim 1, wherein the at least one of the clip legs that runs inside the pockets has at least one cutting edge projecting in the direction of the arced section.

5. The impeller according to claim 1, wherein the at least one of the clip legs that runs in the pockets is longer than the another clip leg which is shorter and that runs outside of the pockets.

6. The impeller according to claim 4, wherein in the middle of the at least one of the clip legs that runs in the pocket, there is a tab that is bent in the direction of the arced section and of the another clip leg that runs outside of the pockets and that has a cutting edge at its free end.

7. The impeller according to claim 4, wherein both of the lengthwise edges of the at least one of the clip legs that runs in the pockets have opposing jagged projections that protrude in the direction of the arced section and that have a cutting edge on one end face.

8. The impeller according to claim 5, wherein the extended section of the at least one of the longer clip legs that runs inside the pockets is bent in such a way that it runs on the side of the clip leg (17) facing away from the shorter clip leg.

9. The impeller according to claim 5, wherein the extended section of the shorter clip leg that runs outside of the pockets is bent in such a way that it faces the longer clip leg.

10. The impeller according to claim 5, wherein the end of the extended section of the at least one of the longer clip legs that runs inside the pocket has a bent section that faces away from the shorter clip leg and that has at least one cutting edge.

11. The impeller according to claim 1, wherein the width of the at least two clip legs is smaller than, or equal to, the clearance of the pockets.

12. The impeller according to claim 5, wherein the at least one of the clip legs that runs in the pocket comprises two longer clip legs, wherein the one shorter clip leg that runs outside of the pockets has a width that corresponds to the width of two pockets positioned next to each other, and the one shorter clip leg is connected via an arced section to the two longer clip legs that are next to each other and that are at a distance from each other by a lengthwise gap, corresponding to the width of the separating wall between the pockets, so that the two longer clip legs, when they have been put in place, each run in separate pockets that are next to each other.

* * * * *